United States Patent [19]

Gerwick et al.

[11] Patent Number: 4,810,424

[45] Date of Patent: Mar. 7, 1989

[54] **METHOD FOR THE RECOVERY OF 12-(S)-HYDROXYEICOSAPENTAENOIC ACID FROM THE RED ALGA *MURRAYELLA PERICLADOS***

[75] Inventors: William H. Gerwick, Philomath; Matthew W. Bernart, Corvallis, both of Oreg.

[73] Assignee: The State of Oregon Acting by and through the Oregon State Board of Higher Education on Behalf of Oregon State University, Eugene, Oreg.

[21] Appl. No.: 107,616

[22] Filed: Oct. 9, 1987

[51] Int. Cl.[4] ..... C11B 1/10

[52] U.S. Cl. ..... 260/412.8

[58] Field of Search ..... 260/412.8

[56] References Cited

PUBLICATIONS

Taylor, W. R., "*Marine Algae of the Eastern Tropical and Subtropical* Coasts of the Americas", *The University of Michigan Press,* (1960).

Cunningham, F. M. et al., "Proinflammatory Properties of Unsaturated Fatty Acids and Their Monohydroxy Metabolites," *Prostaglandins,* 30 (3): 497–509 (1985).

Aponte, N. E., "The Life History and Development of *Murrayella Periclados* (C. Agardh) Schmitz (Rhodophyta, Rhodomelaceae) in Culture," *Crytogamie, Algologie* 8(1): 29–39 (1987).

Croset, M. et al., "Stereospecific Inhibition of $PGH_2$–Induced Platelet Aggregation by Lipoxygenase Products of Icosaenoic Acids", *Biochemical and Biophysical Research Communications,* 112 (3): 878–883 (1983).

Hamberg, M., "Transformations of 5,8,11,14,17–Eicosapentaenoic Acid in Human Platelets", *Biochemica et Biophysica Acta,* 618: 389–398 (1980).

Pace–Asciak, C. R., "Formation of Hepoxilin A4, B4 and the Corresponding Trioxilins from 12(S)–Hydroperoxy–5,8,10,14,17–Icosapentaenoic Acid," *Prostaglandins Leukotrienes and Medicine,* 22: 1–9 (1986).

Takenaga, M. et al., "Comparison of the In Vitro Effect of Eicosapentaenoic Acid (EPA)–Derived Lipoxygenase Metabolites on Human Platelet Function with Those of Arachidonic Acid," *Thrombosis Research,* 37: 373–384 (1986).

Powell, W. S. et al., "Metabolism of Eicosapentaenoic Acid by Aorta: Formation of a Novel 13–Hydroxylated Prostaglandin", *Biochemica et Biophysica Acta,* 835: 201–211 (1985).

Kulkarni, P. S. et al., "Eicosapentaenoic Acid Metabolism in Human and Rabbit Anterior Uvea," *Prostaglandins,* 31(6): 1159–1164 (1986).

Boukhchache, D. et al., "Interactions Between Prostaglandin Precursors During Their Oxygenation by Human Platelets," *Biochemica et Biophysica Acta,* 713: 386–392 (1982).

Lagarde, M. et al., "Lipoxygenase Activity of Intact Human Platelets," *Prostaglandins Leukotrienes and Medicine,* 13: 61–66 (1984).

Hashimoto, Y. et al., "Effects of Arachidonic Acid on the Metabolism of Eicosapentaenoic Acid in Washed Human Platelets," *Thrombosis Research,* 40: 307–317 (1985).

Lagarde, M. et al., "Role of Lipoxygenase Products in Platelet Function: Relation to Fatty Acid Modified Phospholipids," pp. 327–335.

Biomol Catalog Listing for 1986–87, "The Source".

Lopez, A. et al., "Two New Icosapentaenoic Acids from the Temperate Red Seaweed *Ptilota filicina* J. Agardh," *Lipids,* 22 (3): 190–194 (1987).

Gunstone, F. O., "Fatty Acids and Glycerides", *Natural Product Reports,* 95–113 (1987).

Lopez, A. & Gerwick, W. H., *Lipids,* vol. 22, 190–194 (1987).

Higgs, M. D., "Antimicrobial Components of the Red Alga *Laurencia Hybrida* (Rhodophyta, Rhodomelaceae)", *Tetrahedron,* vol. 37, 4255–4258 (1981).

Higgs, M. D., "Hybridalactone, An Unusual Fatty Acid Metabolite from the Red Alga *Laurencia Hybrida* (Rhodophyta, Rhodomelaceae)", *Tetrahedron,* vol. 37, 4259–4262 (1981).

Hawkins, D. J. & Brash, A. R., "Eggs of the Sea Urchin, *Strongylocentrotus purpuratus,* Contain a Prominent (11R) and (12R) Lipoxygenase Activity", *The Journal of Biological Chemistry,* vol. 262, 7629–7634 (1987).

Moore, R. E., *Marine Natural Products, Chemical and Biological Perspectives,* Academic Press, vol. 1, pp. 42–124 (1978).

*Primary Examiner*—Bruce D. Gray

*Attorney, Agent, or Firm*—Klarquist, Sparkman, Campbell, Leigh & Whinston

[57] ABSTRACT

12-(S)-hydroxyeicosapentaenoic acid is chemically extracted from the red alga *Murrayella periclados.* Fresh or frozen quantities of *Murrayella periclados* are first macerated and combined with a 2:1 mixture of chloroform and methanol. This results in an organic fraction containing lipid isolates. After filtration to remove extraneous solids, the organic fraction is evaporated to produce a tar. The tar contains 12-(S)-HEPE which is further purified as desired.

6 Claims, No Drawings

METHOD FOR THE RECOVERY OF 12-(S)-HYDROXYEICOSAPENTAENOIC ACID FROM THE RED ALGA *MURRAYELLA PERICLADOS*

This invention was made with Government support under S.E.A. Grant Project No. R/PD-47 awarded by the National Oceanographic and Atmospheric Administration. The Government has certain rights in the invention.

BACKGROUND OF THE INVENTION

This invention generally relates to the production of polyunsaturated fatty acids, and more specifically to the production of 12-(S)-hydroxyeicosapentaenoic acid.

Polyunsaturated fatty acids possessing double bonds between the third and fourth carbon from the terminal methyl group (commonly known as W-3 fats) have been isolated in the tissues of fish. Tests conducted on these materials show considerable promise in the treatment of numerous diseases, including asthma, arteriosclerosis, heart disease, cancer, and various inflammatory conditions.

While many of the W-3 fats are structurally similar to each other, each may affect the human body in a different way. This has created a demand for a wide variety of W-3 fats for research purposes.

Originally, these materials were obtained by the chemical treatment of fish oils. Fish oils contain eicosapentaenoic acid (EPA) as a basic constituent, which is enzymatically treated to produce the desired product. However, this method is very expensive and time consuming.

Recent research has shown that certain polyunsaturated fatty acids and related derivatives may be isolated from other marine organisms, including algae. For example, Gunstone, F. D. in "Fatty Acids and Glycerides", Natural Product Reports, 95–113 (1987), discusses the isolation of many desired materials from algae. At page 95, the Gunstone article describes the isolation of ethyl (10Z,13Z)-hexadeca-10,13-dienoate from the brown alga *Cystoseira barbata,* and gamma-linolenic acid from the blue-green alga *Microcystis aeruginosa.*

Lopez, A. and Gerwick, W. H., in *Lipids,* Vol. 22, 190–194 (1987) disclose the isolation of two new fatty acid metabolites from the temperate red marine alga *Ptilota filicina.* These metabolites include 5(Z),7(E),9(E), 14(Z),17(Z)-icosapentaenoic acid and 5(E),7(E),9(E),14(Z), 17(Z)-icosapentaenoic acid. The structures of these new compounds, isolated as methyl ester derivatives, have been obtained from detailed nuclear magnetic resonance studies.

A variety of potentially antimicrobial materials have been isolated from the red alga *Laurencia hybrida,* as discussed in Higgs, M. D., "Antimicrobial Components of the Red Alga *Laurencia hybrida* (Rhodophyta, Rhodomelaceae)", *Tetrahedron,* Vol 37, 4255-4258 (1981). According to Higgs, two classes of halogenated metabolites have been isolated from *Laurencia hybrida,* including a series of $C_{15}$ enyne ethers, and a group of halogenated sesquitepenes. Some of these materials have antimicrobial characteristics, while others appear to possess herbicidal activity against numerous broad-leafed plants.

In Higgs, M. D. and Mulheirn, L. J., "Hybridalactone, An Unusual Fatty Acid Metabolite From the Red Alga *Laurencia Hybrida* (Rhodophyta, Rhodomelaceae)", *Tetrahedron,* Vol 37, 4259–4262 (1981), extracts from the red alga *Laurencia hybrida* are again discussed. These extracts include 11-formyl-undeca5(Z),8(E),10(E)-trienoic acid which may possess antimicrobial properties.

Research involving sea urchin eggs is desribed in an article by Hawkins, D. J. and Brash, A. R., entitled "Eggs of the Sea Urchin, *Strongylocentrotus purpuratus,* Contain a Prominent (11R) and (12R) Lipoxygenase Activity", *The Journal of Biological Chemistry,* Vol. 262, 7629–7634 (1987). This article discusses the isolation from sea urchin eggs of a variety of compounds including (11R)-hydroxy-5,812,14-ZZEZ-eicosatetraenoic acid, (12R)-hydroxy-5,8,10,14-ZZEZ-eicosatetraenoic acid, and the (11R) and (12R)-hydroxy analogs of eicosapentaenoic acid.

Finally, an extensive discussion of algal nonisoprenoids is presented in Moore, R. E., *Marine Natural Products, Chemical and Biological Perspectives,* Academic Press, Vol. 1, pp 42–124 (1978). This reference involves a review of important chemical materials obtainable from algae. For example, the materials include those isolated from *Aspargopsis taxiformis,* an edible red alga from Hawaii. Almost 100 compounds have been isolated from this alga, as shown on pps. 61–63 of the reference. Also discussed on pps. 74–91 is the isolation of numerous lipid materials from a variety of forms of blue-green algae.

However, a practical method for isolating many of the potentially valuable fatty acid metabolites is still needed. One important material offering potential in the treatment of numerous diseases is 12-(S)-hydroxy-5(Z),8(Z),10(E),14(Z), 17(Z)-eicosapentaenoic acid (hereinafter designated as 12-(S)-HEPE). In addition to the treatment of diseases, radio-labeled 12-(S)-HEPE offers potential as an antibody-forming agent usable in radio amino assay kits designed to detect 12-(S)-HEPE in living tissue. At present, there is no practical and inexpensive method for producing this material. It has traditionally been manufactured by the enzymatic treatment of eicosapentaenoic acid (EPA) from fish oil to produce a complex mixture from which 12-(S)-HEPE is isolated.

Since a practical and inexpensive method for obtaining this chemical did not exist prior to the present invention, 12-(S)-HEPE has traditionally been expensive and available only in limited amounts.

SUMMARY OF THE INVENTION

The present ineention involves an inexpensive and simple method for producing substantial quantities of 12-(S)-HEPE. This method, as discussed in detail below, will make 12-(S)-HEPE more readily available to research scientists at a lower cost so that they may better understand its benefits in the treatment of disease.

It is an object of the present invention to provide a method for producing 12-(S)-HEPE in substantial quantities at a minimal cost.

It is another object of the invention to provide a method for producing 12-(S)-HEPE which involves a minimal number of process steps, and is readily adaptible to large-scale production conditions.

It is an even further object of the invention to provide a method for producing 12-(S)-HEPE which avoids the need to enzymatically derive the material from fish oil.

It is a still further object of the invention to provide a method for producing 12-(S)-HEPE in relatively pure form.

To accomplish these and other objects, a method for producing 12-(S)-HEPE is disclosed which involves chemical extraction of the material from the red alga *Murrayella periclados.* Fresh or frozen quantities of *Murrayella periclados* are first macerated and combined with a 2:1 mixture of chloroform and methanol. This produces an organic solvent fraction containing lipid isolates from the *Murrayella periclados.* After filtration to remove extraneous solids, the organic fraction is evaporated to produce a tar. The tar contains 12-(S)-HEPE which is further purified to produce the final product.

These and other objects, features and advantages of the invention will be more fully discussed in the following detailed description of a preferred embodiment.

Detailed Description of Preferred Embodiment

The present invention involves a novel procedure for producing substantial quantities of 12-(S)-HEPE at a low cost. The chemical structure of 12-(S)-HEPE is as follows:

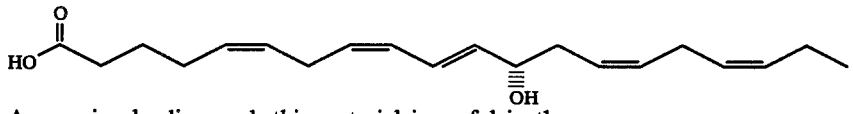

As previously discussed, this material is useful in the study of metabolism and is potentially valuable in the treatment of disease.

To produce 12-(S)-HEPE, samples of the red alga *Murrayella periclados* are first obtained. This alga is native to Puerto Rico, and may presently be found in that area, and in other tropical regions of the world. Thereafter, the *Murrayella periclados* is treated in accordance with the following example:

EXAMPLE

*Murrayella periclados* in either fresh or fresh-frozen form is macerated (e.g. chopped and/or cut) and steeped for about 30 minutes in a chemical extractant, preferably consisting of a 2:1 mixture of chloroform and methanol. The resulting liquid mixture is then passed through filter paper and allowed to cool. The mixture includes a discrete organic phase which contains lipid materials from the *Murrayella periclados.* This phase is separated from the aqueous phase of the mixture using a separatory funnel. The organic phase is then evaporated under reduced pressure. The resulting product consists of an organic tar containing the 12-(S)-HEPE. A typical yield of tar is 8.0 grams of tar per 363 grams (dry weight) of extracted *Murrayella periclados.*

The organic tar is then added to about 350 cc of thin layer chromatography grade silica gel in a vacuum funnel measuring 9.5 cm I.D. by 8.5 cm in height. The tar is progressively eluted with increasingly polar mixtures of ethyl acetate in isooctane. The eluted materials resulting from the addition of 1% to 40% ethyl acetate in isooctane are discarded. However, the eluted materials obtained from the introduction of 50–100% ethyl acetate in isooctane are retained. The retained materials are evaporated to remove the solvent, and the resulting product is applied to a thick layer chromatography plate (Kieselgel 60 $F_{254}$, 2 mm thick).

The plate is then developed with diethyl ether/hexane/acetic acid in a 55:45:1 ratio. After development is completed, the UV-active band at Rf=0.35 to 0.45 is scraped off. The scraped material is pulverized and the 12-(S)-HEPE eluted by placing the pulverized material in several volumes of a 1:1 mixture of diethyl ether and ethyl acetate. The resulting slurry is allowed to stand for several minutes, and then filtered. The fitrate is vacuum evaporated and redissolved in diethyl ether.

The resulting solution of 12-(S)-HEPE in ether is washed with a saturated aqueous solution of sodium bicarbonate which removes residual acetic acid. Thereafter, the solution is washed with deionized water to yield a pure preparation of 12-(S)-HEPE.

The qualitative identification of the 12-(S)-HEPE can be made by a thin layer chromatographic comparison with standardized quantities of the material, or by conventional spectroscopic and analytical methods (nuclear magnetic resonance spectroscopy or mass spectrometry).

In a modified version of the foregoing process, the product may be purified as a derivative which involves methylation of the 12-(S)-HEPE to the corresponding methyl ester using diazomethane followed by vacuum silica gel chromatography and elution with 10–20% ethyl acetate in isooctane.

Use of the method described herein results in a substantial yield of 12-(S)-HEPE at a fraction of the cost in comparison with the enzymatic treatment of fish oils. Likewise, the method can easily be modified to produce much larger, commercial quantities of the product.

Having herein described a preferred embodiment of the invention, it is contemplated that suitable modifications may be made by those skilled in the art within the scope of the invention. Accordingly, the invention shall only be construed in accordance with the following claims.

What is claimed is:

1. A method for the production of 12-(S)- HEPE comprising:

obtaining a supply of the red alga *Murrayella periclados;* treating said supply with a chemical extractant to obtain an organic fraction containing lipid materials from said supply;

isolating 12-(S)-HEPE from said organic fraction.

2. The method of claim 1 wherein said supply of red alga *Murrayella periclados* is macerated prior to said treating with said chemical extractant to release lipid materials stored therein.

3. The method of claim 1 wherein said chemical extractant comprises a mixture of about two parts chloroform to about one part methanol.

4. The method of claim 1 further comprising the step of methylating said 12-(S)-HEPE to produce a methyl ester thereof.

5. A method for the production of 12-(S)-HEPE comprising:

obtaining a supply of the red alga *Murrayella periclados;* macerating said supply so as to release lipid materials stored therein;

treating said macerated supply with a chemical extractant to obtain an organic fraction containing said lipid materials from said supply, said chemical extractant comprising a mixture of about two parts chloroform to about one part methanol; and isolating 12-(S)-HEPE from said organic fraction.

6. The method of claim 5 further comprising the step of methylating said 12-(S)-HEPE to produce a methyl ester thereof.

* * * * *